US009068363B2

(12) United States Patent
Rojas Pimiento

(10) Patent No.: US 9,068,363 B2
(45) Date of Patent: Jun. 30, 2015

(54) ADJUSTABLE METAL FORMWORK SYSTEM FOR CONCRETE STRUCTURES

(76) Inventor: Efrain Rojas Pimiento, Bogota (CO)

( * ) Notice: Subject to any disclaimer, the term of this patent is extended or adjusted under 35 U.S.C. 154(b) by 282 days.

(21) Appl. No.: 13/511,125

(22) PCT Filed: Dec. 9, 2010

(86) PCT No.: PCT/IB2010/055704

§ 371 (c)(1),
(2), (4) Date: May 21, 2012

(87) PCT Pub. No.: WO2011/070530

PCT Pub. Date: Jun. 16, 2011

(65) Prior Publication Data

US 2012/0286134 A1 Nov. 15, 2012

(30) Foreign Application Priority Data

Dec. 10, 2009 (CO) ..... 09-141278

(51) Int. Cl.

| | |
|---|---|
| ***E04G 9/06*** | (2006.01) |
| ***E04G 11/12*** | (2006.01) |
| ***E04G 13/02*** | (2006.01) |
| ***E04G 17/04*** | (2006.01) |
| ***E04G 17/065*** | (2006.01) |
| ***E04G 17/14*** | (2006.01) |
| ***E04G 11/10*** | (2006.01) |
| ***E04G 17/00*** | (2006.01) |
| *E04G 17/075* | (2006.01) |

(52) U.S. Cl.

CPC ..... *E04G 11/10* (2013.01); *E04G 17/075* (2013.01); *E04G 9/06* (2013.01); *E04G 13/025* (2013.01); *E04G 11/12* (2013.01); *E04G 13/023* (2013.01); *E04G 17/001* (2013.01); *E04G 17/045* (2013.01); *E04G 17/0652* (2013.01)

(58) Field of Classification Search

CPC ..... E04G 9/06; E04G 11/00; E04G 11/02; E04G 11/06; E04G 11/08; E04G 11/12; E04G 13/02; E04G 13/023; E04G 13/025; E04G 13/026; E04G 13/028; E04G 17/00; E04G 17/075

USPC ..... 249/48, 49, 51, 194, 219.2

See application file for complete search history.

(56) References Cited

U.S. PATENT DOCUMENTS

| | | | | |
|---|---|---|---|---|
| 2,595,286 A * | 5/1952 | Otte et al. | ..... | 249/49 |
| 6,676,102 B1 * | 1/2004 | Hambelton | ..... | 249/49 |

* cited by examiner

*Primary Examiner* — Michael Safavi

(74) *Attorney, Agent, or Firm* — Hoglund & Pamias, PSC; Roberto J. Rios

(57) ABSTRACT

This invention relates to a set of pieces or parts making up a system of metallic adjustable formwork for concrete structures in civil Works which functions is to allow the assembly, junction and adjustment of the formwork system in the most efficient way with the use of a system of adjustable formwork which looks for to use the shorter quantity of metallic panels as accessory during the project execution. The way as the each element has characteristics of specially defined shape, size and function to get a rigid structure, which allow to build a mold over which the concrete is poured maintaining their characteristics and perform such functions rapidly, efficiently and securely.

20 Claims, 10 Drawing Sheets

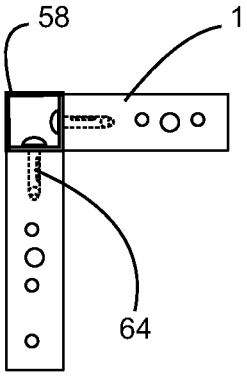
FIG. 9.1
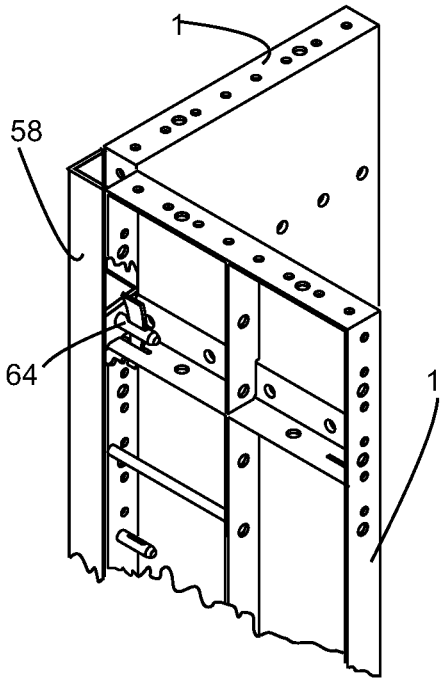
FIG. 9.2
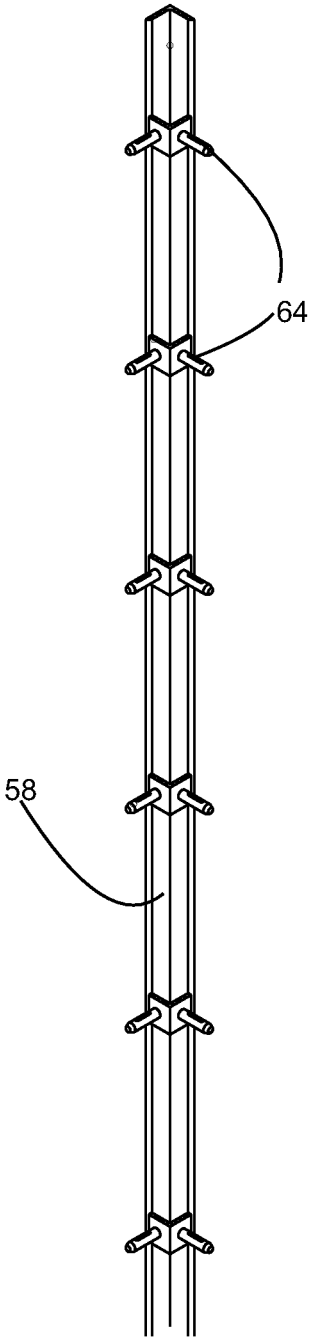
FIG. 9
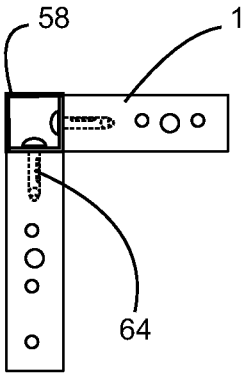
FIG. 9.4
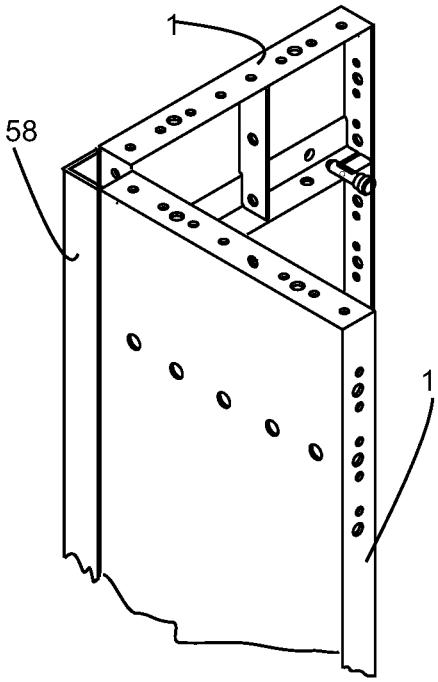
FIG. 9.3

ADJUSTABLE METAL FORMWORK SYSTEM FOR CONCRETE STRUCTURES

TECHNOLOGICAL FIELD

This invention relates to metallic formwork systems for the casting and molding of concrete structures in site for the execution of civil Works in which intervene certain quantity of elements such as metallic panels, corner pieces, laminated profiles in angle, plates, spacers, aligners and bolts permitting to give rigidity to the formwork in order to mold a predetermined concrete structure.

The metallic formworks are temporally armed structures composed of elements and accessories with a specially defined shape, form and function to get a rigid structure allowing building a mold over which the concrete is poured which following its solidification must be disassembled and withdraw to leave a molded structure at sight with predesigned shape and characteristics.

The panel for formworks is a metallic element used in the building of civil Works that acts as basic part of the mold to shape a concrete structure. Its main characteristics is to be composed of metal sheets with holes that allow adding joint and adjustment elements at the moment of its disassembly with other panel with similar characteristics.

The accessories are manufactured metallic pieces that allow assembling and adjusting the metallic formwork. Among the most used accessories there are laminated profiles in right angle (corner piece angle), plates, spacers, aligners, aligner holders y bolts which at the same time are composed of elements with special shapes and characteristics that allow the correct operation at the assembling of the metallic formwork.

PREVIOUS TECHNOLOGY

To make concrete structures in civil Works, it is necessary to prepare a mold to obtain the required shapes according to the need of the work and the architectonic demands of the building projects. To carry out such operation metallic elements such as metallic panels, corner pieces, laminated profiles, plates, spacers, aligners y aligners holders are used since they allow pour the concrete and obtain the desired shapes. The technological advances are evidenced in the development of each mold and the interaction of each new element within an existent system or the conformation of a new one.

Among the state of the art there is the patent U.S. Pat. No. 2,019,195 (March, 1934) by Bascon E. Simpson, which joins parallel panels through screwed yokes that cross the concrete in each perimetral hole and other hole in the core. There are four perimetral holes located along the transversal supports or crossbeam of the panel and a hole in the core of the panel to give support. Patent U.S. Pat. No. 2,019,195 has the difficulty in the tightening of the yokes use as spacers, due to a traction force is required in the yoke in each size of the formwork to give the separation of mold panels, besides the yoke can be removed without damaging the molded structure since it has not locking shape and the molded structure does not maintain an uniform thickness because it depends on the tightening force. The present invention uses a panel which smooth surface has equidistant and transversally collinear holes and not only on its perimeter but along the inner of the panel, which allow using a single panel to mold different geometrical structures without using other bigger or shorter molds as would be required with the invention of patent U.S. Pat. No. 2,019,195. Besides the spacers of the new request use an element which ends has two smooth surfaces and a hole, and in the other end the tip is threaded to receive another element that has its own spanner to screw. This new patent only needs a single traction force using the spanner to assembly the spacers and not two traction forces, and also it has its own hook to remove the spacer following the molding of the structure using the hole of the end that hast the two smooth surfaces and the hole.

There is other patents such as petition U.S. Pat No. 2,107,427 which inventor is Albert J. Schwarzler, this type of formworks intends to maintain a structure through anchoring. The new petition does not require to be anchored to the floor, besides that it is portable and adjustable. Note that the spacers of patent U.S. Pat. No. 2,107,427 are located at the outer part of the panels which does not allow giving continuity to the mold to joint the adjacent panels vertically, which is why the invention with patent U.S. Pat. No. 2,107,427 has the a technical problem that it just can give shape to a structure with the shape of a panel and several molds of the same type can't be used to permit creating a continuous structure with several molds vertically.

The request of Colombian patent 03-100558 of the invention by Gustavo Serrano Rodríguez has smooth spacers with circular holes that adjust through pines that can be unfitted at the moment of the concrete casting due to the pressure exerted between the pin and the circular hole, the smooth spacers has greater dimensions due to the oval deformation of the initial circular holes increasing in each use the thickness of the structure. The new petition uses a joint spacing system that use four elements, a rod with threaded end in one of the ends and a end with two smooth surfaces and a hole in the opposite end, a conventional Hook to remove the rod, a third element with a thread that compress the end of the rod and its other end has a smooth surface (quadrant) that allow the coupling of a spanner that screws the spacing system, and a fourth element called spacing adjustment spanner. The spacer of the new patent avoids the adjustment to each size of the mold through pins since it just requires to screw until the stop screw in a single size with its spanner, maintaining a molded structure always with an uniform thickness which does not happen with previous technologies.

The Colombian patent 03-100558 can't be adjusted to create structures or figures shorter than the length of their panels. To create each structure a panel with the appropriate dimension is required. The present invention has the possibility to adjust to create shapes shorter than the panel dimension and formworks adjusted in columns, beams, walls, slabs, channels or ditches using a conventional wedge pin that fits in the various collinear holes that it has in the smooth surface of the panel of the present petition system.

Some petitions of patents use aligners designed for each system, patent U.S. Pat. No. 5,078,360 which inventor is Vittorio Spera has some aligners sliding on "T" shaped-rail that serves as aligner and as guide to slide a locking element and the Colombian patent 03-100558 has a clamp which hoods fix to the props of the formwork module and adjust to a "U" shaped profile. Generally these ways of alignment work exclusively for each system and generally for safety just in horizontal position. The new petition uses a conventional aligner profile in the shape of rectangular box that stands the force of a "J" shaped-screw or a "Y" shaped screw tightened by a nut with special characteristics.

In formworks systems a numberless of accessories are used for better alignment, which may vary depending on the type and position of the holes where "H", "L", "U" "O" shaped-profiles among others are used and also accessories that hold these profiles as hooks or nails aligners holder like those used by companies as Formesan, Efco and Unispan or "L" shaped as Forsa, Symons, Westerm Forms, WTF or simply they align the profiles by crossing a threaded screw between the panels facing each other and this at the same time crosses the double aligner holding the whole system provided the nuts in each side are correctly secured as do companies like Doka, Unispan, Symons and Fermar. The present invention has two types of aligner holders one of them in the shape of "J" which adjusts the aligner promptly and securely improving the molding of the panel joints. The other one has a "Y" shape which also is compatible with the system and that can be adapted to any existent formwork system in order to correct or improve the alignment especially in formworks systems that have wear in its holes used for align or fatigue in the accessories.

The inconvenient with the previous technology is the impossibility to uses the same panels and/or elements with different measurements and functions because they are manufactured with fixed measurements and specific functions, the previous technology does not have elements to adjust the panels according to the structure to be molded. The formworks systems has the technical problem of maladjustment when they secure to smooth spacers through pins or the problem of damaging the structure or difficulty to remove the form when using yokes of threaded spacers as those existent in the state of the art. In the conventional systems smooth ties are used such as those used by companies Efco, Symons, Forsa, WTF and Formesan; having, often, an inconvenient since for being smooth and thin they deform when interacting with the rods of the wall to be melted and it makes harder and in some cases impossible to remove them from the hardened walls. Due to the force extraction with heavy machines (extractor hammers) that increase or deform the hole, it causes that the ties or spacers in their consequent uses cause an even more thick wall affecting the budget.

Also in traditional systems screws totally threaded are used as spacers such as those used by Unispan, Doka, Symons, Efco, Fermar which removal is harder without using a stiff sleeve (PVC tubes or metallic tubes) products that increase the work cost with the additional inconvenient of not knowing if the tightening is enough and therefore in each event the wall deforms causing discontinuity and at the same time increasing and delaying the finishing work.

The corner pieces are used in several systems worldwide with fixed measures obligating the user to complete the walls with small pieces to compensate the final measurement as Unispan-Efco-Symons-Doka-Formesan-Westerm-Forms-WTF-Forsa-do. Besides they are always used as corner pieces in inner walls forming 90 degrees. Currently there is the problem that when combining the corner piece with narrow panels in the inner corners the formwork position displaces deforming the final wall. These problems solve with the complement of the present invention which involves two solutions: an adjustable corner piece equidistantly perforated that interacts with the panels leading to multiple possibilities or use with minimum accessories and a profile with pins that fits in the metallic panels permitting to assembly the corner piece with the exact measurement. This can also be used as corner piece angle in the system.

The present petition of patent solves the problems of adjustment of the existent formwork systems, allow the adjustment of modules to form different structures with square and rectangular shapes in walls, beams, columns or channels and do not damage the molded structure when removing a spacer with stop threaded screw in one of its ends. Using a J-shaped aligner holder (preferably with horizontal alignment) that speeds up the installation of the aligner rapidly and securely, permitting to correct any irregularity or curvature in the panels since it hooks them taking them to the aligner achieving more uniform walls. Also using a Y-shaped aligner holder (vertical or horizontal alignment) for a safe locking, which also can be used in other systems it has perimetral bands or reinforcements of any type or size of holes since it adapts to any type of horizontal or vertical formwork improving the joints because acts just like the J-shaped aligner holder. Besides we can adjust the corner piece to be used in different measurements and turns which could not do with traditional corner pieces. It allow to assemble a customized corner piece using the profile with welded pins without the need of completing compensatory pieces and at the same time disassemble into use the panels in other function and the profile and the welded profile would act as outer corner piece angle to take advantage of the minimum elements of the system decreasing the assemble times as well as the cost of projects execution.

DESCRIPTION OF THE INVENTION

The present invention has the objective to introduce an adjustable metallic formwork system for concrete structures that permit to make molds conformation in civil Works, which has the elements and accessories necessary to structure rapidly, reliably and safely such molds with the characteristics that they are adjustable, multifunctional and adaptable to other systems permitting to correct, improve and speed up the work.

The formwork system is mainly composed of a metallic panel, an adjustable corner piece, the laminated profile in right angle, a profile with welded holes, a plate, spacers, aligners, a aligner holder and the bolts, being the metallic panel the main elements and the remaining parts are accessories since their use must guaranty the rigidity, alignment and positioning of the structure to be molded varying the number of pieces required of each accessory in the system.

The remaining parts called accessories have shapes and functions that allow giving rigidity, alignment, positioning and adjustment to the metallic formwork. The invention requires the use of some accessories found in the market such as the bolt (wedge-pin), but used to achieve different adjustments and to secure the panels in any positions, the plate that secures the side joint and the fixation of metallic panels, the corner piece angle that permits adjacent turns of the panels, the box-shaped aligner and the L-shaped bolt, the other accessories have important creations and variations to get the best use speeding up the work of assemble of the formwork safely, precisely and economically.

The panel is a new metallic element used in the civil work building, which acts as basic part to form a concrete structure. The new panel has a determined number of holes which vary in diameter to allow the coupling of the accessories when the formwork structure is formed locating the panels along the other, adjacently or face to face. In contrast to the existent panels, the new panel has equidistant holes in it smooth surface for the passing of the spacers, such holes also permit the longitudinal adjustment of the formwork at the moment of the assemble, which is a technical solution of the system with respect to the current formworks. The panel is structured through perimetral metallic bands transversally perforated along the surface and L-shaped angles as reinforcement and where the collinear holes cross the smooth part of the formwork panel.

The adjustable corner piece is a element in right angle (90°) which allow a turn in the inner part of the walls, which also has equidistant holes in the smooth sides that permit to couple a metallic panel perpendicular to one of its sides to achieve the turn using the wedge-pin accessory for the adjustment and graduation, achieving different combinations and measurements equal to or lesser than the maximum one, forming with it not only one but two angles of 90° simultaneously with a minimum of accessories for adjustment The system has a smooth profile in right angle (90°) that makes possible a turn in the panels perpendicularly adjacent, located at the outer corner. This smooth profile has equidistant holes of two different diameters to select the joint and adjustment system (plate or wedge-pin) depending on the pressure that the formwork will exert during its use.

The profile with equidistant welded holes acts as base to assemble a corner piece with the required size, being this one modular, when interacting with two metallic panels of the system disregarding their dimensions, when using this customized corner piece we avoid to use short pieces when doing internal and external turns to 90°, pieces that due to their size deform the walls during the turns which later can be disassembled to use its component in other functions such as continuous wall (the two panels) and the profile with welded pins also acts as outer corner piece angle making possible external adjacent turns, which only are achieved with the use of the corner piece angle.

The spacers for the separation of the metallic panels face to face to a required distance with which the thickness of the concrete wall to be molded is defined has a stop screw, a smooth surface to support the traction force and a threaded end in one end to adjust to a thread that also has a stop screw for which we only adjust this one in a side of the formwork speeding up the operation and guarantying the uniformity of the structure, since these when are installed or removed are not deformed.

The aligner is an element that permits to align the panels when they are put side by side and guaranty that at the moment of the concrete pouring the structure does not displace and loses its continuity.

The accessory wedge pin is needed to secure the panels in any positions and also the plates, being the wedge pin the fundamental element to secure the new system that allows the adjustment and turn of the intermediate panels that compose the adjustable formwork system.

BRIEF DESCRIPTION OF FIGURES

FIG. 9 is a side view with welded pins that allow internal and external turns of panels as a base to create customized corner pieces.

FIG. 9.1 shows the assemble of the demountable outer corner piece using the profile with welded profiles from its upper view.

FIG. 9.2 shows the assemble of the demountable outer corner piece using the profile with welded pins with a perspective view and detailing the pin securing.

FIG. 9.3 shows the assemble of the demountable corner piece using the profile with welded pins with a perspective view where an inner corner piece is formed.

FIG. 9.4 shows the assemble of the demountable corner piece using the profile with welded pins from its upper view for an inner corner piece.

DETAILED DESCRIPTION OF FIGURES AND BETTER WAY TO EXECUTE THE INVENTION

Figure 1:
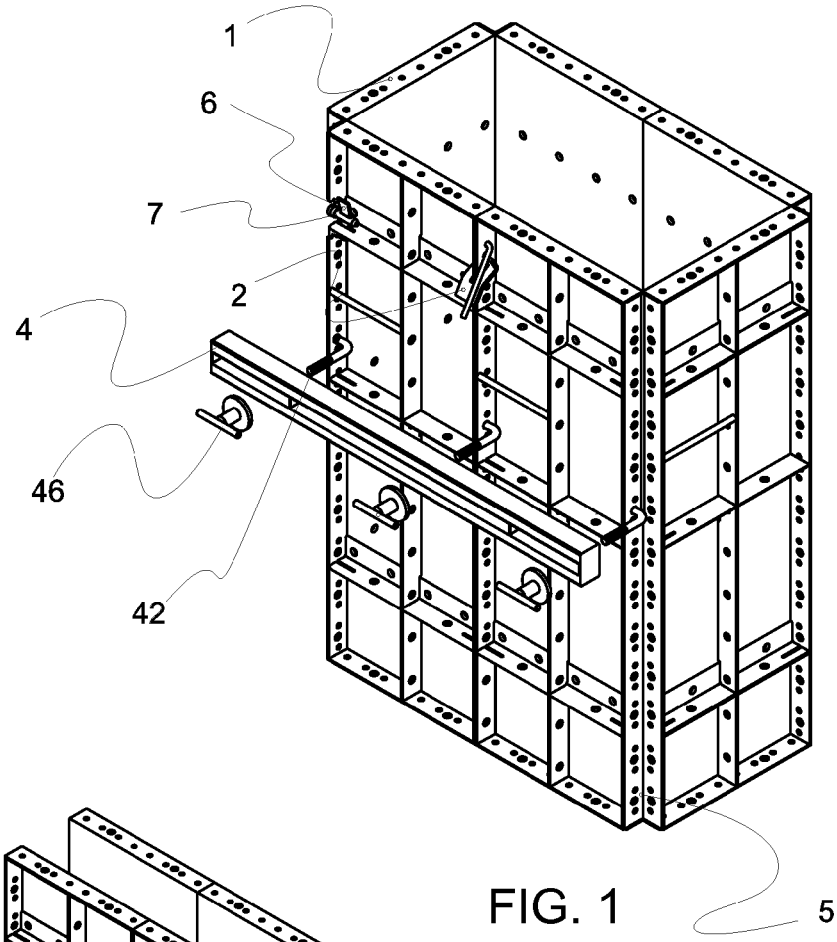
FIG. 1 shows a perspective view of the adjustable system assemble to conform a concrete block.
Figure 2:
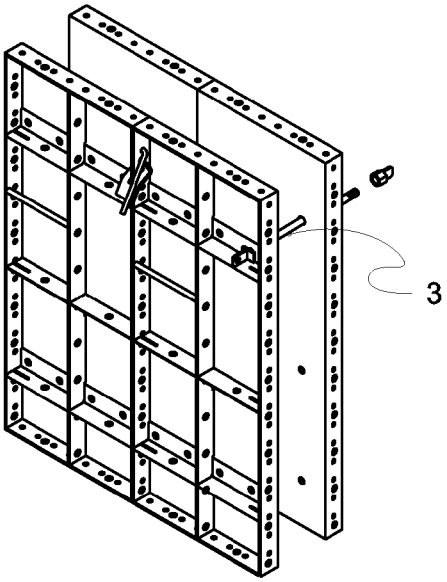
FIG. 2 is a perspective view of the metallic panel position to build a wall.

Taking as reference FIG. 1 we can see the parts that compose the formwork system. The metallic panel (1) is located at the side, adjacent and front to the other ones with equal characteristics. Once put they are secured and aligned with the plate (2) and the stop spacer (3) showed in FIG. 2, when concrete walls as conformed. At last the aligner is located (4) adjusting it to the structure through a J-shaped screw (42) and the adjustment nut (46). The right angle profile (5) is an accessory that permits to turn and join an adjacent form changing the structure continuity. The accessory bolt pin (7)-wedge (6) allows to secure the metallic panels (1) when they are put in any positions.

Figure 3:
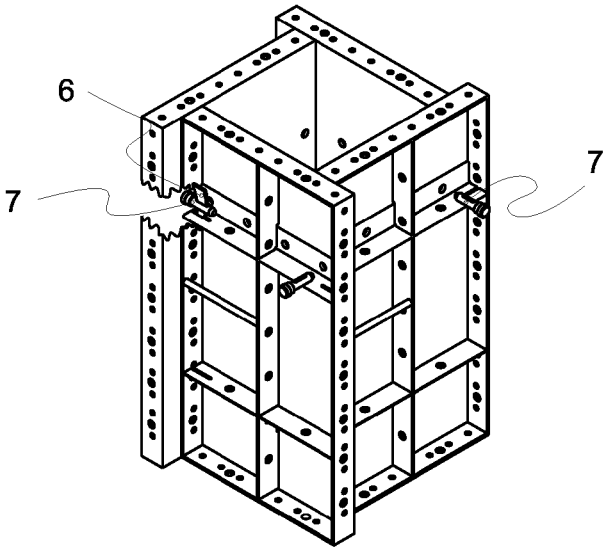
FIG. 3 is a perspective view that shows the metallic panels displacing the position of the panels to intermediate adjustable joints fixed through wedge-pins.

FIG. 3 allows looking the displacement of the metallic panels (1) to assemble a formwork with dimensions different than the concrete column and the shape in which the pin (7) wedge (6) accessory acts to secure the panels in their different adjustments.

Figure 4:
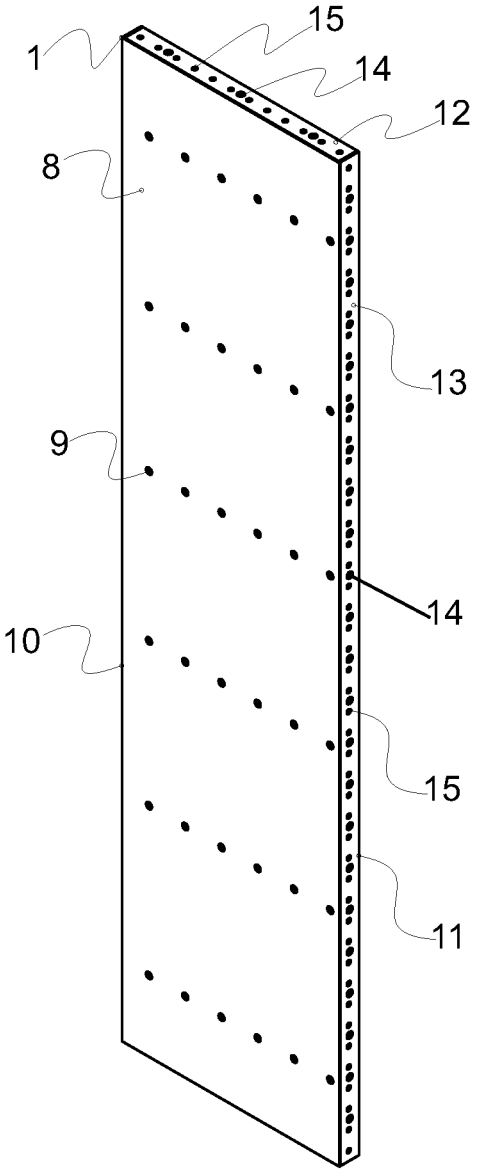
FIG. 4 shows the metallic panel in perspective from its front side where the collinear transversal holes that allows the system adjustment are observed.
Figure 5:
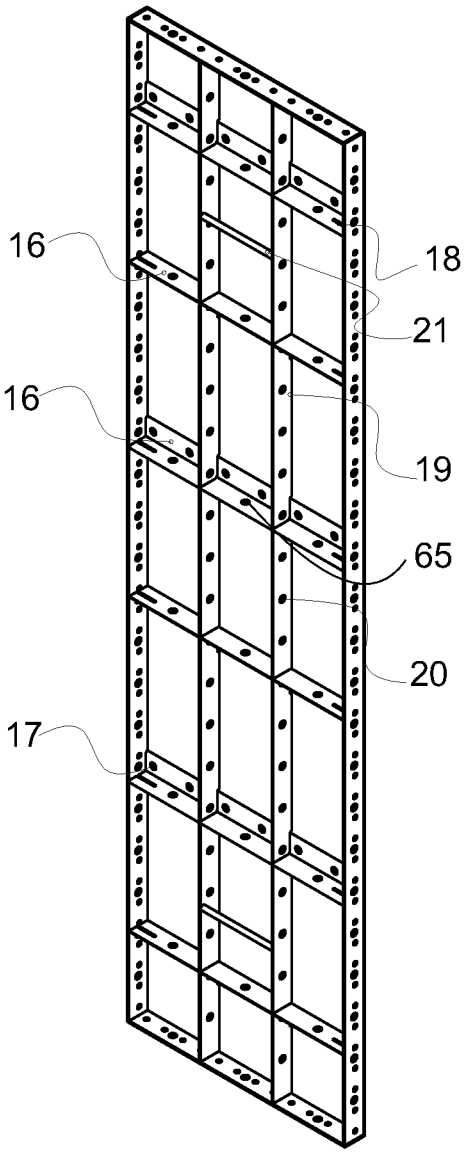
FIG. 5 shows the metallic panel in perspective from its lower part where the L-shaped reinforcements that support the transversal holes for adjustment are observed.

FIG. 4 shows in detail a perspective view of the metallic panel (1) from its side composed of a smooth metallic sheet (8) with equidistant transversal holes (9) on its surface which allow to make different adjustments depending on the selected edge (10), (11) varying its length with respect to the first hole (9) near to the perpendicular edge (10), (11) that permits to form the formwork. The metallic bands (12), (13) allow to mark and also structure the metallic panel (1), such bands has equidistant holes (14), (15) along its surface. FIG. 5 shows the perspective view of the back side of the metallic panel with the reinforcement (16) which are L-shaped angles transversally welded that has collinear holes (17) that align with the holes (9) of the smooth metallic sheet (8). Other characteristic of the reinforcement (16) are the holes (65) that receive the J-shaped aligner holder in vertical position and the slots (18) that permit the pass of the wedges (6) that secure the bolt pins (7). The metallic bands (19) are vertical reinforcement longitudinally welded in the inner side of the metallic panel (1) which have holes (20) with align with the holes (14) of the metallic band(13). The element (22) is a rod welded to the metallic bands (19) that permit that an operator manages the metallic panel (1).

FIG. 4 shows the distribution of the frontal holes (9) in the smooth side of the panel (1) which permits 77 possibilities of graduation outdoors, 23 combinations inner wall to one hundred and eighty degrees 180° and twelve combination inner wall to ninety degrees—90°, when one by one is graduated with the different holes (9). A total of one hundred and twelve possibilities are possible using the panels with a profile of 60 cm width and its equidistant holes to each 10 centimeters as their corresponding accessories.

Example: if we use the edge (11) as reference point and approximate from the edge (10) with a panel (1) located and adjusted with the pin (7), wedge (6) perpendicularly on the vertical line of the holes (9) farthest to the edge (11) we are decreasing the measurement of the panel (1) in steps of 10 cm, which measurements are: 60 centimeters, 50 centimeters, 40 centimeters, 30 centimeters, 20 centimeters and 10 centimeters. Or we use the edge (10) as reference point and we approximate to it from the edge (11) with a panel (1) located and adjusted by the pin (7) wedge (6) perpendicularly on the vertical line of holes (9) farthest to the edge (10) we would decreasing the measurement of the panel (1) in increments of 10 centimeters which measurements would be: 55 centimeters, 45 centimeters, 35 centimeters, 25 centimeters, 15 centimeters and 5 centimeters. With these two options of adjustment we can obtain different combinations. (Note that from the edge (10) we decrease in increments of 10 centimeters and from edge (11) in increments of 5 centimeters.

To disappear the holes (9) that are not used in the projects execution plastic plugs are used which are commonly found in the market. They fill the holes guarantying uniformity in the finishing.

Figure 6:
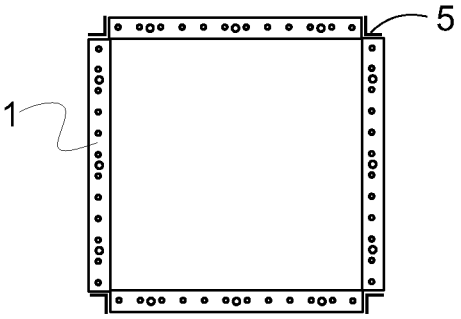
FIG. 6 is an upper view of a formwork for column in normal position with four panels in their maximum dimension using four corner piece angles.
Figure 7:
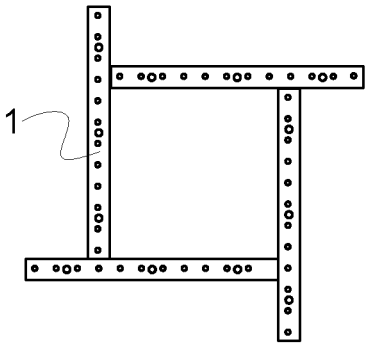
FIG. 7 is an upper view of the formwork with displacement for adjustment of the panels varying their dimensions.

FIG. 6 highlights the basic conformation of a formwork with four metallic panels (1) generating geometrically a square with equal sides, this configuration can be modified longitudinally using the corner of the corner piece angle (5) that is secured by the plate or pin (7), wedge (6). This configuration is possible due to the holes (9) as shown in FIG. 7; due to the different holes (9) on the smooth metallic sheet (8) of the metallic panel (1), and the holes (14) of the metallic bands (12), (13) and be able to achieve different measurements of formwork with just four panels through some adjustments in the accessories.

To complement the system a plate that is composed of a sheet which is folded with an obtuse angle and a slot until its middle profile in the shape of "V", which allow guiding and fitting the plate securing the metallic bands of the metallic panels to join them with the flaps of the plate to avoid an axial motion. One of the flaps has a folding in right angle that allow that the sheet acts as reinforcement on the rod welded to the plate. The folding on the rod forms a right angle to give the form of hook. Finishing its course following the folding the rod has a conic shape that allows locating easily the plate in the hole of the metallic bands.

Figure 8:
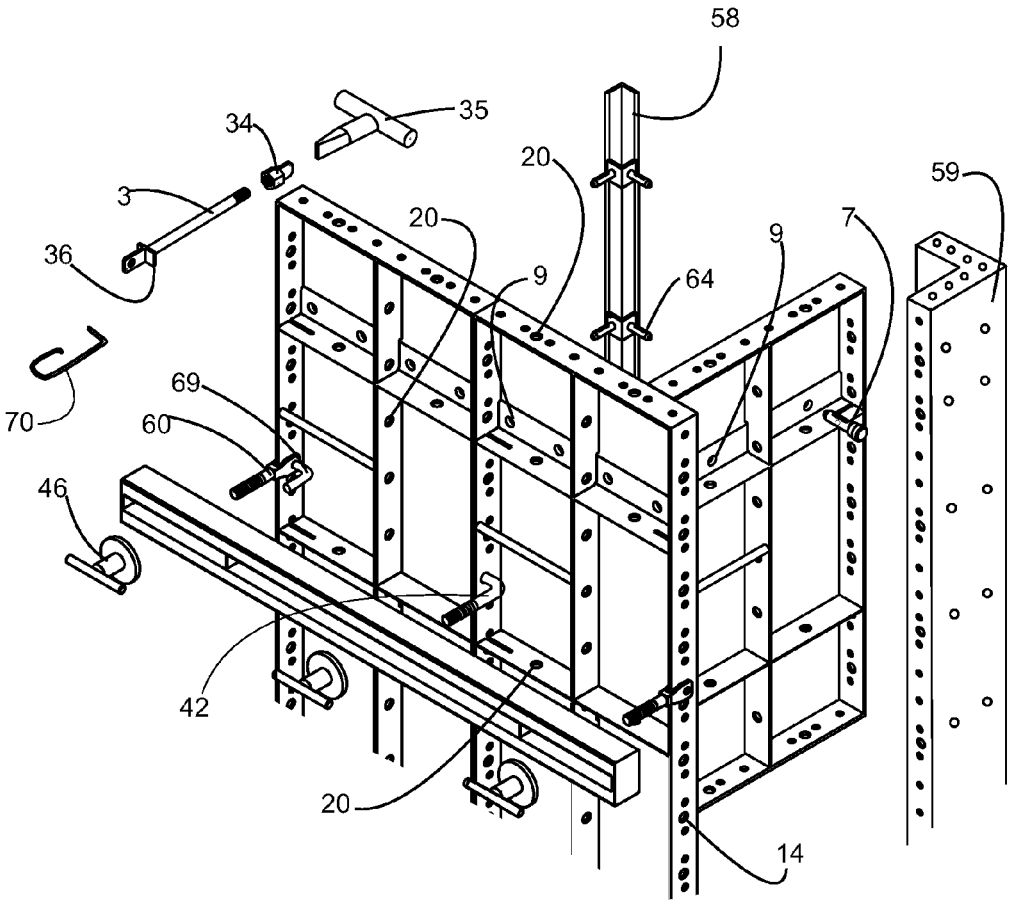
FIG. 8 is a view of all the elements that allow the adjustment of the system as well as the joint and alignment of the panels.

FIG. 8 shows the elements that allow conforming the system. The screw (60) conforms a new locking system, which allows installing it rapidly through the plate and it in turn joint the panels allowing them putting the aligner (4) to be adjusted by the nut (46) of adjustment. The screw (60) is an accessory that also serves to any type of formwork that joint and align with holes and a conventional aligner. The holes (20) for being placed in the vertical and horizontal profiles of reinforcement in the formwork allow to place the aligners to join the formworks vertically and horizontally, besides they allow and intermediate locking when no hooking can be made in the panel ends.

FIG. 9 shows a side view with equidistant welded holes (58) which allow joining two perpendicular panels (1): outer as corner piece angle and inner as corner piece.

FIG. 9.1 and FIG. 9.2 show the side view with welded pins, replacing the corner piece angle in the outer side where inner contact sides were used.

FIG. 9.3 and FIG. 9.4 show the side views with welded pins as base to conform a customized corner piece where outer contacts sides were used.

In these two cases as observed in FIG. 9.1, FIG. 9.2, FIG. 9.3 and FIG. 9.4, the holes (14) of the panel (1) where they match with the slot (18) they will receive welded pins (64) adjusting the wedge (6) to can carry out the previously described operations. As for example to unmake these actions to use these components in other functions.

Figure 10:
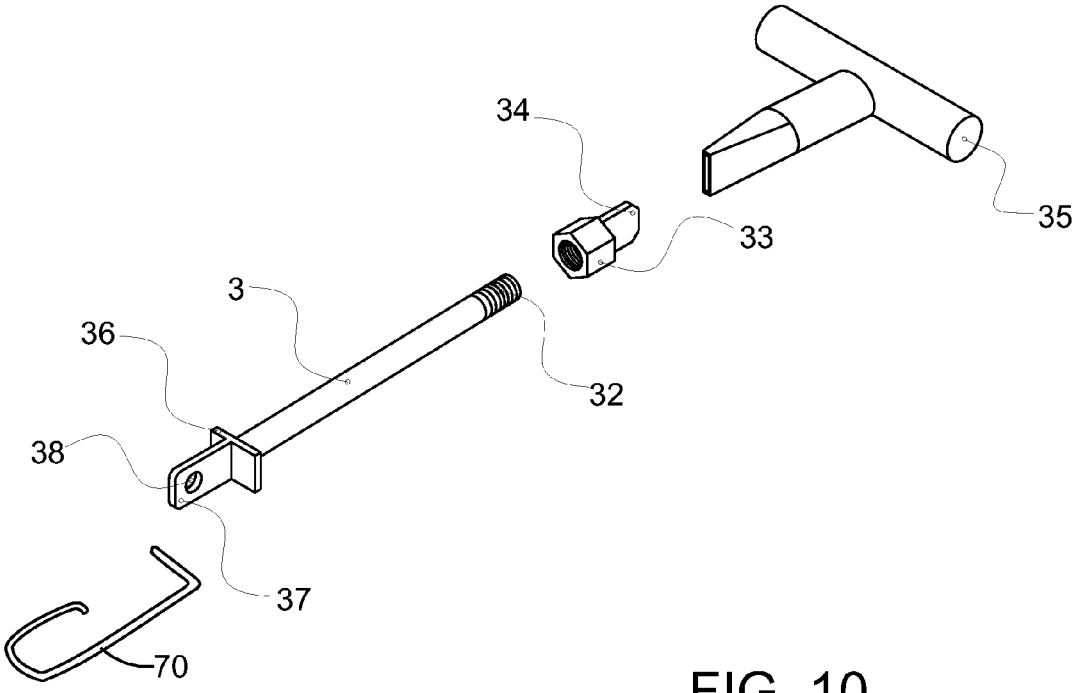
FIG. 10 is a perspective view of the spacer accessory of stop screw that fixes the thickness of the structure to be molded.

FIG. 10 shows the stop spacer accessory (3) which is composed of three elements: a rod partially threaded (32) on which a nut is put (33), such nut has a stop guide (34) that guaranties a predetermined width of the wall to be adjusted during the assemble by the spanner. (35). In the opposite to the rod nut (32) there is a cassette deck (36) which acts as stop when is introduced in the hole (9) of the metallic panel (1). The cassette deck (37) perpendicularly welded on the cassette deck (36) has a hole (38) that allows removing easily the spacer (3) during the disassemble of the formwork structure. The stop spacer (3) with circular profile, stiff, steeled and smooth on its rod, guarantees the wall thickness when is tightened due to its calibration with a stop (36) that it has in one of its ends, composed of two cassette decks that work as stops (36) when are introduced in the hole (9) of the first panel. In the other end of the spacer (3) there is a nut (32) in the tip that is completely covered by a nut (33) which in one of its ends is completely covered acting as nut (33) and also as stop when is totally tightened following having crossed the second panel leaving the panels face to face at the exact distance which finally will be the wall uniform width. This spacer (3) guarantees the wall width uniformity during the whole Project and also the removal of all the spacers easily without deforming the wall, for such effect we support on the adjustment spanner (35) and the extractor hook introduced in the hole (38).

Due to that the threaded tip (32) of the spacer (3) is always protected during the fusing of the concrete with the nut (33) up to its stop to maintain the width of the wall, the problem of unscrewing of the systems that use thread to adjust and leave the thread unprotected making that the concrete hardens making harder the disassemble is solved.

Figure 11:
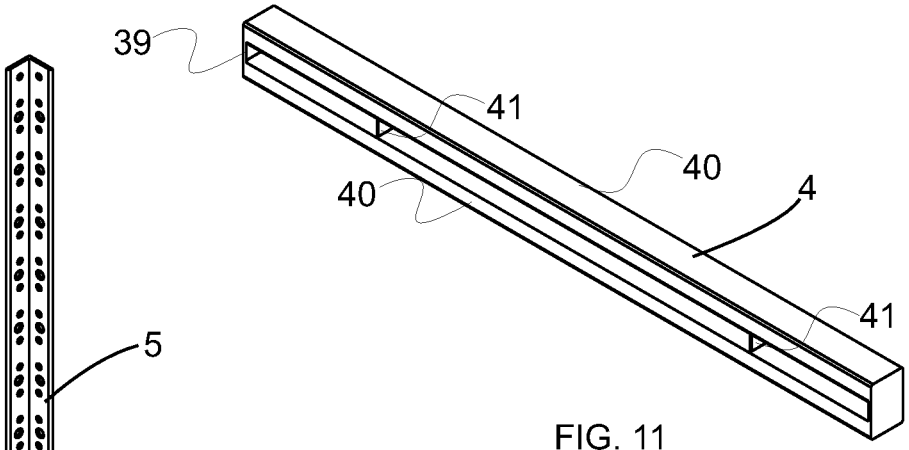
FIG. 11 is a perspective view of the aligner.
Figure 12:
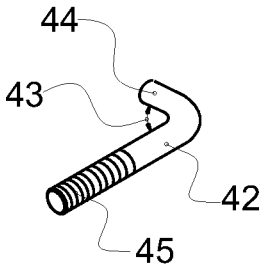
FIG. 12 is a perspective view of the J-shaped screw that makes part of the system alignment set.
Figure 13:
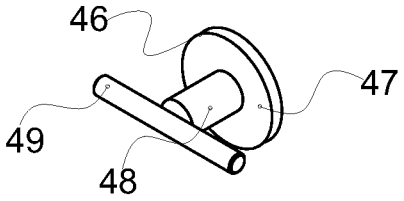
FIG. 13 is a perspective of the adjustment nut of the alignment set for the Y-shaped or J-shaped screw.

The accessory box aligner (4) shown in FIG. 11 for the adjustable system is composed of the crossbar (39) which is a set structured by rectangular tubes (40) and reinforcement cassette decks (41) that at the same time act as spacers between the rectangular tubes (40) to permit the pass of the J-shaped screw (42) shown in FIG. 12. Such screw is folded with an obtuse angle (43) to have the shape of hook and allow that the end (44) can be introduced in the hole (14) of the metallic band(12) as well as (13) in the bands of the intermediate transversal reinforcement. The opposite end (45) of the screw (42), is threaded until its middle profile. The adjustment nut (46) shown in FIG. 13 is composed of a washer (47) welded to cylinder (48) internally threaded with characteristics similar to the J-shaped screw (42) and a rod a (49) transversally welded that allow adjusting manually the adjustment nut (46).

The aligner (4) adjusts with two elements that are always previously joined and assembled, to wit, the J-shaped screw (42) or Y-shaped screw (60) and the adjustment nut (46). The screws (42) and (60) are tightened through the adjustment nut (46) which core has a internally threaded cylinder that receives the nut (45) or (62) of the screws (42) or (60) and turns through the transversal welded rod (49) which allows adjusting the nut (46) manually.

The problem solved by the aligner set is the quantity of operations that must be done to assemble the accessories on the metallic panels and guarantying the structure stability. The aligner set introduces a new option in the operation of the adjustable metallic formwork system alignment using a piece that allow interacting with the accessories such as the crossbar (4), the adjustment nut (46) and the plate. Such piece can be described as a hook and fixation screw in which one of its ends has a J-shaped screw (42) or Y-shaped screw (6) to situate in the holes of the metallic bands and reinforcement of the metallic panel or be secured by the plate to assemble the crossbar and adjust it with the nut (46) until the structure becomes continuous by the functions of the aligner(4), the hooking screw (42) or screw (60) and the adjustment nut (46).

The double aligner can be like the one used by companies such as: Doka, Symons or Fermar and within this element a new J-shaped (42) or Y-shaped (60) hooking screw can be introduced which acts as aligner holder and that have two pieces, the screw (42) or screw (60) of FIG. 27 and FIG. 26 respectively and where the adjustment nut (46) is shown assembled in FIG. 13. The adjustment nut (46) complements the operation of the screw (42) or screw (60), which enters through the intermediate slot (39) of the aligner (4) hooking the formwork in any hole placed vertically or horizontally for the aligner holder of the screw (42) or screw o (60); this way it not just adjust rapidly the aligner (4) with the nut (46) but also brings close the forms with the aligner (4) in such a way that the joints or connections between the panels (1) are improved to get a better finished of the structure.

Figure 14:
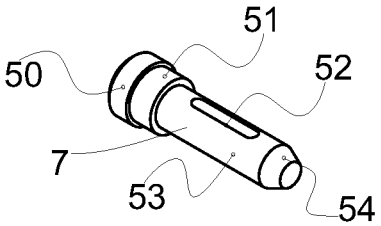
FIG. 14 is a perspective view of the pin bolt.
Figure 15:
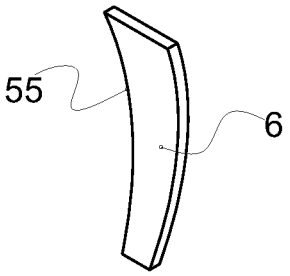
FIG. 15 is a perspective view of the wedge for the pin bolt.

FIG. 14 shows a detailed perspective view of the pin bolt (7) which is composed of the head (50) with a higher diameter, a step (51) which characterizes for giving a stop or distance between the metallic panel (1) the right angle profile (5) and the wedge (6) of FIG. 15 during the assemble of such elements. The pin bolt has a slot (52) centered along the cylindrical form (53) of the pin bolt (7) which functions is allow the pass of the wedge (6) and a conic finishing that allow guiding easily the pin bolt to the holes (9) and (14) of the panel (1) and the holes (56) of the right angle profile (5).

In FIG. 15 the wedge (6) has a concave shape (55) which makes easier the placing of it during the assemble by the operator.

Figure 16:
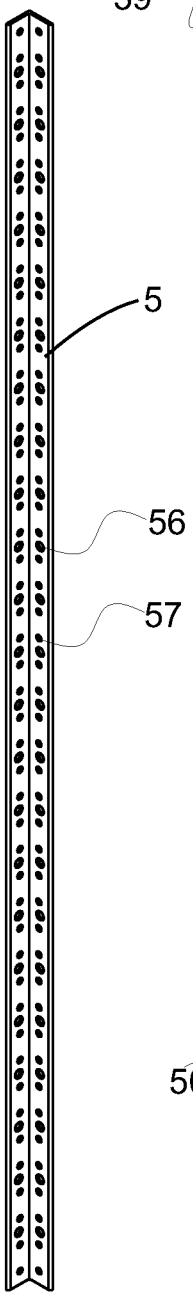
FIG. 16 is a perspective view of the right angle side and its multiple holes and perforation aligned with different diameters.

FIG. 16 shows a side view of the right angle (5) which holes (56) and (57) align with holes (14) and (15) respectively of the metallic panel (1) and which main functions is allow the turn of the panels when it is necessary to change the formwork continuity. This procedure involves two alternatives of adjustment, one of them with a pin (7)-wedge(6) to secure the holes (14) of the metallic panel (1) with the holes (56) of the right angle profile (5), and the other with the plate to secure the holes (15) of the metallic panel (1), with the holes (57) of the right angle profile (5) according to the required resistance, preference or availability of accessories.

Figure 17:
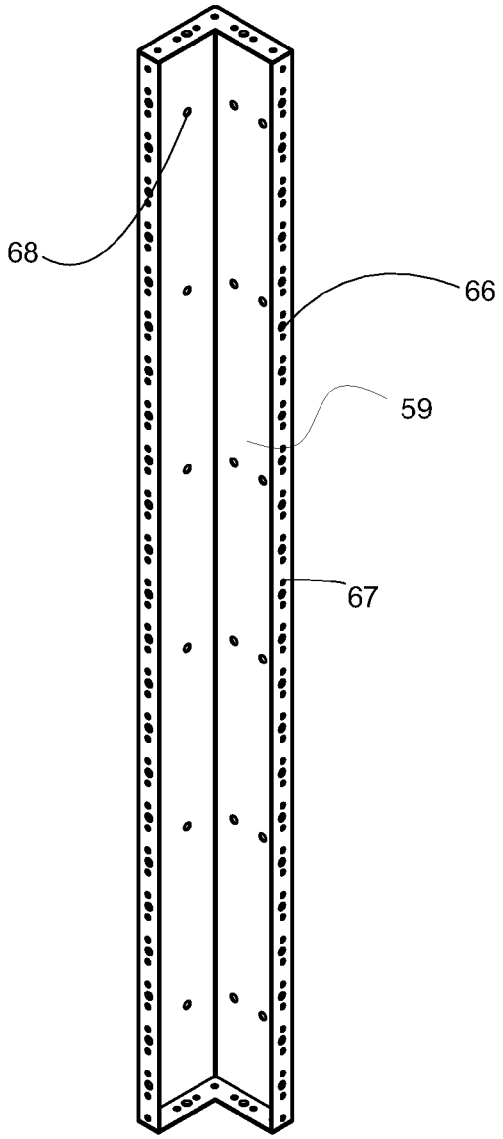
FIG. 17 shows the adjustable corner piece that allow the turn of the structures conformation such as columns, protruding and other structures different to uniform blocks and walls which can be adjusted when interacting with the panels.

FIG. 17 shows the accessory to allow the turn and adjustment when interacting with panels in an adjustable metallic formwork system.

The accessory in FIG. 17 has a main characteristic to allow the turn of the metallic panels when the structure changes its direction or the shapes and dimensions of the projected structures obliging to adapt an additional element that may adapt easily to the system. The corner piece (59) is an accessory that has as main characteristic to form one or two right angles and have multiple holes (68) which make easier to adapt and adjust the accessory elements that make part of the adjustable metallic formwork system for concrete structures and has holes (66) and holes (67) that also can align with holes (14) and holes (15) of the panel (1). The corner piece is the elements that allow the turn of the metallic panels when the continuity is lost. The corner piece is a piece that must be adapted easily to accomplish the conditions of the adjustable metallic formwork system when right angles are formed or when the dimensions of such panels do not cover totally the required dimensions o the concrete structures since it is adjustable.

Figure 21:
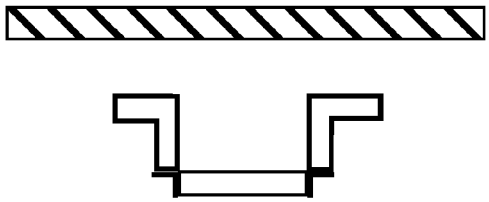
FIG. 21 shows the configuration of a formwork that allows the conformation of a wall with a column using two corner pieces of the system (conventional way, without adjustment)
Figure 22:
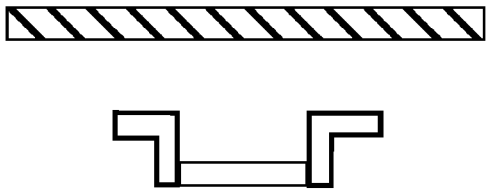
FIGS. 22 and 23 show the configuration of a formwork that allows the conformation of a wall with a column with different width that use the system corner piece in its adjustment possibilities.
Figure 23:
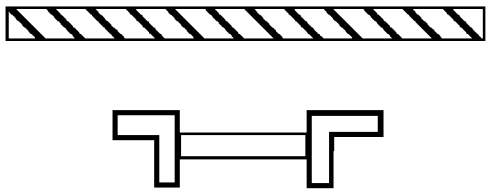

The graduations that can be made with the corner piece are shown from FIG. 21 to FIG. 27, where FIGS. 21, 22, and 23 show the traditional ways that can be made with other formwork systems but FIGS. 24, 25, 26, and 27 shows the solutions to the building of structures with the shape of columns, channels, protuberances, T-shaped walls and L-shaped walls through the applications of an adjustable corner piece (59).

The corner pieces are used in different systems worldwide with fixed sizes obliging the users to complete the walls with shorter pieces to compensate the final size, besides they must be used always and exclusively as corner pieces in walls that form ninety degrees—90°. Currently exist the problem that when combining the pieces with the narrow panels in the corner the positions of the formwork displaces deforming the final wall. This problem is soled with the complement of the present invention which involves: a smooth profile (58) with welded equidistant pins (64) of FIG. 9 that it exactly in the holes (14), near to the slots (18) of the panel (1) to be secured by the wedges (6). As shown in FIGS. 9.1, 9.2, 9.3 and 9.4. the smooth profile (58) with welded pins (64) acts as base for a new corner piece which may be assembled by fitting it in the holes (14) of the bands (13) of the two metallic panels (1). The profile with welded pins (58) allow assembling a corner piece like the shown in FIG. 9.2, formed by two panels at the required exact distance without the need of completing with compensatory pieces as with other formwork systems and then it can be dissembled to use its components in other operations.

The smooth profiles with welded equidistant pins (58) of FIG. 9 acts as a base for the new corner piece as shown in FIGS. 9.1 and FIG. 9.2; which can be assembled by fitting it in the corner of each module (1). The profiles with welded pins (58) allow assembling a corner piece formed by modules that conform panels with the required size and then they can be disassembled to use its modules in pieces or other operations, as the molding in joints and customized folding without needing compensatory pieces as other formwork systems.

Figure 18:
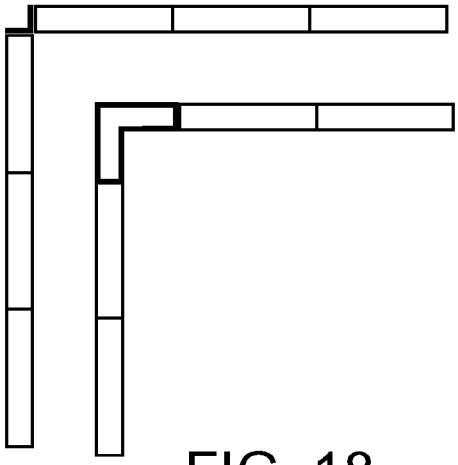
FIG. 18 shows a formwork that allows the conformation of a L-shaped wall corner using a corner piece and a corner angle.
Figure 19:
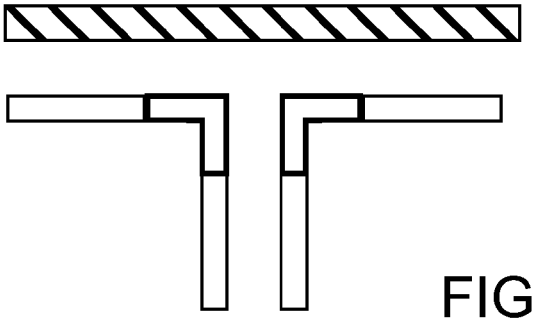
FIG. 19 shows a formwork that allows the conformation of a T-shape wall using the corner pieces.
Figure 20:
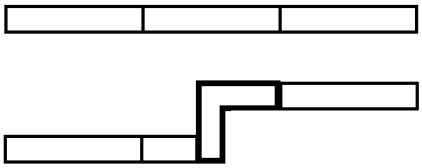
FIG. 20 shows the configuration of the adjustable corner piece in a formwork that allows the conformation of a wall with two length thickness.
Figure 24:
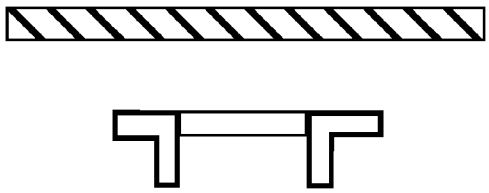
FIG. 24 shows the configuration of a formwork that allows the conformation of a wall with a same width with the use of adjustable corner pieces using them as formwork with the measurement of one of its sides.

The graduations can be made with the corner piece shown in FIG. 18, FIG. 19, FIG. 20, FIG. 21, FIG. 22, FIG. 23, y FIG. 24; where FIG. 18, FIG. 19 and FIG. 21 show the traditional ways with other formwork systems but FIG. 20, FIG. 22, FIG. 23 and FIG. 24 show the solution to building of structures in the shape of columns, channels, protuberances, T-shaped walls and L-shaped walls through the applications of the corner piece (59) and the welded pins profile (58) of the adjustable formworks system.

Another accessory that allow the adjustment of the aligner (3) is the screw (60) that has two flanges (61) that joint the metallic bands (13) of two formwork modules. The screw (60) can be adjusted through the adjustment nut (46) which receives the threaded end (62) that fits until the inner stop of the thread so that the width of the structure to be molded is uniform during the tightening. The hole (63) of each flange (61) allows the pass of a pin that secures the screw (60) to the lateral sides of the panel.

Figure 25:
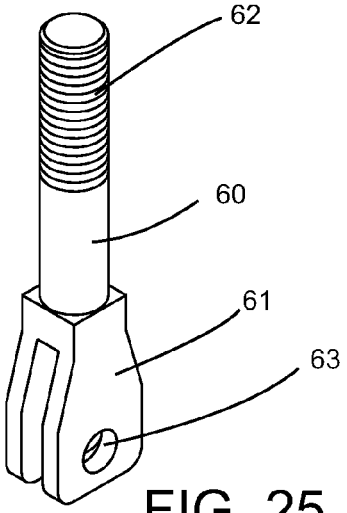
FIG. 25 shows another accessory, the aligner holder which can be used with the box-shaped aligner in any hole of the system hold by the pin bolt

FIG. 25 shows the Y-shaped crew aligner holder (60) which composes a new hooking system in vertical or horizontal positions allowing the intermediate hooking in the perforated reinforcement when no hooking can be made in the ends of the panel (1), speeding up and correcting this operations in different formworks systems safely.

Figure 26:
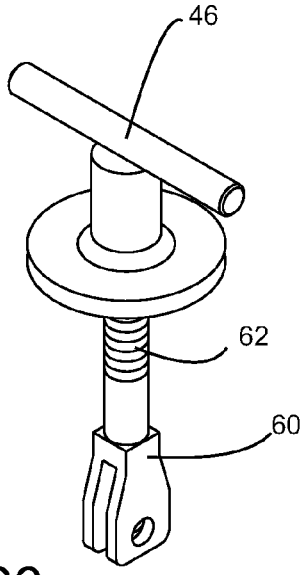
FIG. 26 shows the assemble of the accessory for the adjustment of the aligner with the Y-shaped aligner holder.
Figure 27:
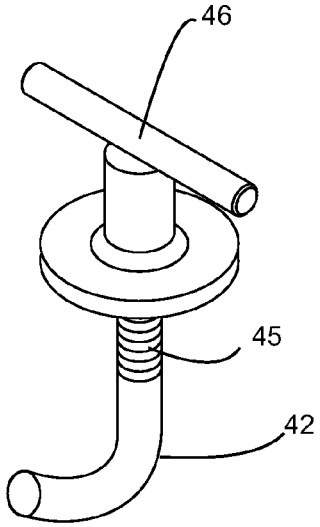
FIG. 27 shows the assemble of the accessory for the adjustment of the aligner with the J-shaped adjustment nut.

FIG. 26 shows the assemble of the Y-shaped screw aligner holder (60) which allows the adjusting o the aligner (4) in this system. FIG. 27 shows the operation o the Y-shaped screw aligner holder but with a J-shaped screw aligner holder (42.). The Y-shaped screw aligner holder (60) has two flanges (61) that join the metallic bands (13) of the two modules of the formwork (1). The screw (60) adjusts through the adjustment nut (46) which receives the threaded end (62). The hole (63) of each flanges (61) allow the pass the plate rod that secures (60) and the aligner (4) to the lateral sides of the panel, guarantying during the procedure to bring near all the lateral bands (12) and the lateral band (13) o the panels (1) towards the aligner (4) maintaining a good alignment and finishing in the walls. This procedure can be made by replacing the plate for the L-shaped pin bolt (69) of FIG. 8, to use this alignment system in any formwork systems in vertical or horizontal position without disregarding the size or shape of the holes of the bands or reinforcement.

The present invention guaranty a better exploitation of each elements that compose the metallic formwork system which contribute to speed out the operations in the concrete molding process in civil work building, guarantying better finishing and reducing the amount o pieces and accessories required for the project execution in which intervene the adjustable metallic panels with any sizes, adjustable corner pieces that decrease the amount of accessories used for the adjustments, a profiles with welded pins that acts as base to form a customized corner piece which also can be used as corner piece angle, a stop tie that guaranties the uniformity in the wall during the whole project and a rapid and safe alignment system which can be also used in any existent metallic formwork systems.

The present invention guaranties an uniform width o the wall segments due to the stop spacer, which allows graduating the formworks for the molding of irregular structures with the use of equidistant welded pins and collinear transversal holes in the front part of each modules. Besides this solves the problem of columns and protuberances molding with the corner piece adjustable to the formwork panels, and has adjustment elements with stops for the alignment that make easier the assemble, width and uniformity in the structures.

The invention claimed is:

1. A metallic formwork system for concrete molded structures comprising:

at least one panel having a smooth front side including a plurality of collinear transversal holes, metallic bands around the periphery of the back side of said panel, said metallic bands also having a plurality of collinear transversal holes and reinforcement elements attached to the back side of said panel;

a L-shaped corner piece accessory having two perpendicular smooth front sides, each having a plurality of collinear transversal holes, and metallic bands around the periphery of the back side of said L-shaped corner piece accessory, said metallic bands also having a plurality of collinear transversal holes;

a stop spacer accessory insertable through a collinear transversal hole on the smooth front side of said panel;

an aligner accessory having an opening, at least one aligning screw accessory having one threaded end insertable through the opening of said aligner accessory and the other end attachable to at least one of: said metallic bands and said reinforcement elements of said back side of the panel;

a pin bolt insertable through at least one of: a hole of said collinear transversal holes of the smooth front of said panel, a hole of said collinear transversal holes of the metallic bands of said panel, a hole of said collinear transversal holes of the smooth front of said L-shaped corner piece accessory, and a hole of said collinear transversal holes of the metallic bands of said L-shaped corner piece accessory, said pin bolt having a cylindrical form and a slot centered along said cylindrical form;

a L-shaped smooth profile having a plurality of pins insertable through the collinear transversal holes of said metallic bands, said plurality of pins having a cylindrical form and a slot centered along said cylindrical form;

a L-shaped corner piece angle having two perpendicular sides, each having a plurality of longitudinally collinear transversal holes;

a concave-shaped wedge insertable through at least one of: the slot of said pin bolt and a slot of the pins of said L-shaped corner accessory; and a plate having a rectangular shape, said plate being folded at an angle and having an axially receiving pass-through slot, and a linking pin attached to said plate.

2. The metallic formwork system of claim 1, wherein said stop spacer accessory comprises a rod having a threaded portion at one end and a stop portion at the other end.

3. The metallic formwork system of claim 1, wherein the other end of said aligning screw accessory comprises a hook element folded at an obtuse angle, said hook element being inserted through at least one of: a hole on the metallic bands on the back side of said panel and a hole on said reinforcement elements to attach said aligning screw accessory to the back of said panel.

4. The metallic formwork system of claim 1, wherein the other end of said aligning screw accessory comprises two spaced-apart flanges, each flange having a hole so that a pin is inserted through the holes of said two flanges and at least one of: a hole on the metallic bands on the back side of said panel and a hole on said reinforcement elements to attach said aligning screw accessory to the back of said panel.

5. The metallic formwork system of claim 1, further comprising an adjustment nut receiving the threaded end of said aligning screw accessory when inserted through the opening of said aligner accessory, said adjustment nut having a washer element pushing said aligner accessory against the back of said panel.

6. The metallic formwork system of claim 1, wherein said pin bolt has at one end a step portion having a diameter greater than the diameter of said cylindrical form and a head portion having a diameter greater than the diameter of said step portion and at the other end has a conical end portion having a diameter smaller than the diameter of said cylindrical form.

7. The metallic formwork system of claim 1, wherein said concave-shaped wedge has an upper end and a lower end smaller than said upper end.

8. The metallic formwork system of claim 2, further comprising a spacer nut having at one end a receiving portion for receiving the threaded portion end of said stop spacer accessory and at the other end a stop guide protruding from said spacer nut.

9. The metallic formwork system of claim 2, wherein the stop portion of said rod further comprises a deck portion perpendicular to and extending from said stop portion and having a removing hole configured to allow removal of said stop spacer accessory from said panel.

10. The metallic formwork system of claim 8, further comprising a spanner tool having at one end a stop guide receiving portion engageable to said stop guide and at the other end a handle so that said spacer nut is rotated when said handle is rotated.

11. The metallic formwork system of claim 9, further comprising a stop spacer removing tool having at one end an inserting portion insertable inside said removing hole and at the other end a handle so that said stop spacer accessory is removed from said panel when said handle is pulled.

12. The metallic formwork system of claim 1, wherein said panel further comprises a rod attached to back side of said panel allowing an operator to move said panel.

13. The metallic formwork system of claim 5, wherein two adjacent panels are aligned side-by-side by attaching the other end of said aligning screw accessory to the back side of the adjacent panels, inserting the threaded end of said aligning screw accessory through the opening of said aligner accessory, engaging said adjustment nut with the inserted threaded end of said aligning screw accessory and rotating said adjustment nut so that washer element pushes said aligner accessory against the back of said two adjacent panels effectively aligning said two adjacent panels.

14. The metallic formwork system of claim 7, wherein two panels are joined together perpendicular to each other by inserting said pin bolt through a hole of said collinear transversal holes of the smooth front of one panel and a hole of said collinear transversal holes of the metallic bands of the other panel and inserting the lower end of said concave-shaped wedge through the slot of said inserted pin bolt and a slot provided on a reinforcement element attached to the back side of the other panel.

15. The metallic formwork system of claim 7, wherein two panels are joined together side-by-side by at least one of:

inserting said pin bolt through a hole of said collinear transversal holes of the metallic bands of one panel and a hole of said collinear transversal holes of the metallic bands of the other panel and inserting the lower end of said concave-shaped wedge through the slot of said inserted pin bolt and a slot provided on a reinforcement element attached to the back side of the other panel; and inserting said linking pin through a collinear transversal hole of the metal bands of one panel and a collinear transversal hole of the metal bands of the other panel and further inserting a portion of the metal band of said one panel and a portion of the metal band of said other panel inside said axially receiving pass-through slot.

16. The metallic formwork system of claim 8, wherein two panels are positioned parallel to each other by inserting the stop spacer accessory through a collinear transversal hole on the smooth front side of one panel and a collinear transversal hole on the smooth front side of the other panel and engaging the threaded portion of said stop spacer accessory with said spacer nut so that the parallel distance between said two panels is adjusted as said spacer nut is rotated.

17. The metallic formwork system of claim 1, wherein said L-shaped corner piece accessory is attached to a panel by at least one of:

inserting said pin bolt through a collinear transversal hole of one smooth front side of said L-shaped corner piece accessory and a collinear transversal hole of the metal bands of said panel and further inserting said concave-shaped wedge through the slot of said inserted pin bolt and a slot provided on a reinforcement element attached to the back side of the panel;

inserting said pin bolt through a collinear transversal hole of the metal bands of said L-shaped corner piece accessory and a collinear transversal hole of the metal bands of said panel and further inserting said concave-shaped wedge through the slot of said inserted pin bolt and a slot provided on a reinforcement element attached to the back side of the panel; and inserting said linking pin through a collinear transversal hole of the metal bands of said L-shaped corner piece accessory and a collinear transversal hole of the metal bands of said panel and further inserting a portion of the metal band of said L-shaped corner piece accessory and a portion of the metal band of said panel inside said axially receiving pass-through slot.

18. The metallic formwork system of claim 1, wherein said L-shaped corner piece accessory is attached to said L-shaped corner piece angle by inserting said linking pin through a collinear transversal hole of the metal bands of said L-shaped corner piece accessory and a longitudinally hole of a side of said L-shaped corner piece angle and further inserting a portion of the metal band of said L-shaped corner piece accessory and a portion of the side of said L-shaped corner piece angle inside said axially receiving pass-through slot.

19. The metallic formwork system of claim 1, wherein said L-shaped corner piece angle is attached to a panel by at least one of:

inserting said pin bolt through a longitudinally transversal hole of a side of said L-shaped corner piece angle and a collinear transversal hole of the metal bands of said panel and further inserting said concave-shaped wedge through the slot of said inserted pin bolt and a slot provided on a reinforcement element attached to the back side of the panel; and inserting said linking pin through a longitudinally transversal hole of a side of said L-shaped corner piece angle and a collinear transversal hole of the metal bands of said panel and further inserting a portion of the side of said L-shaped corner piece angle and a portion of the metal band of said panel inside said axially receiving pass-through slot.

20. The metallic formwork system of claim 1, wherein said L-shaped smooth profile is attached to a panel by inserting a pin of the plurality of pins of said L-shaped smooth profile through a collinear transversal hole of the metal bands of said panel and further inserting said concave-shaped wedge through the slot of said inserted pin and a slot provided on a reinforcement element attached to the back side of the panel.

* * * * *